US010051386B2

(12) United States Patent
Pinto et al.

(10) Patent No.: US 10,051,386 B2
(45) Date of Patent: Aug. 14, 2018

(54) HEARING AID

(71) Applicant: GN Hearing A/S, Ballerup (DK)

(72) Inventors: Alexandre Pinto, Copenhagen (DK); Jens Henrik Steffens, Bronshoj (DK)

(73) Assignee: GN Hearing A/S, Ballerup (DK)

( * ) Notice: Subject to any disclaimer, the term of this patent is extended or adjusted under 35 U.S.C. 154(b) by 0 days.

(21) Appl. No.: 14/986,259

(22) Filed: Dec. 31, 2015

(65) Prior Publication Data

US 2017/0171676 A1 Jun. 15, 2017

(30) Foreign Application Priority Data

Dec. 14, 2015 (EP) ..... 15199946

(51) Int. Cl.
*H04R 25/00* (2006.01)
*H01Q 1/27* (2006.01)
*H01Q 7/00* (2006.01)

(52) U.S. Cl.
CPC ..... *H04R 25/554* (2013.01); *H01Q 1/273* (2013.01); *H01Q 7/00* (2013.01); *H04R 25/55* (2013.01); *H04R 25/65* (2013.01); *H04R 25/608* (2013.01); *H04R 2225/021* (2013.01); *H04R 2225/025* (2013.01); *H04R 2225/51* (2013.01); *H04R 2225/55* (2013.01)

(58) Field of Classification Search
CPC ..... H04R 2225/021; H04R 2225/025; H04R 2225/51; H04R 2225/55; H04R 25/55; H04R 25/60; H04R 25/65; H04R 25/554; H04R 25/556
See application file for complete search history.

(56) References Cited

U.S. PATENT DOCUMENTS

| | | | | |
|---|---|---|---|---|
| 7,715,580 | B2 * | 5/2010 | Nielsen | H04R 25/60 381/322 |
| 8,442,252 | B2 * | 5/2013 | Meosky | H04R 25/60 381/322 |
| 8,538,056 | B2 * | 9/2013 | Ishibashi | H04R 25/652 381/330 |
| 2004/0138723 | A1 * | 7/2004 | Malick | H04R 25/552 607/57 |
| 2005/0099341 | A1 * | 5/2005 | Zhang | H01Q 1/273 343/700 MS |
| 2011/0019830 | A1 * | 1/2011 | Leibman | H01Q 1/273 381/60 |
| 2011/0022121 | A1 * | 1/2011 | Meskins | A61N 1/37229 607/57 |
| 2014/0185848 | A1 | 7/2014 | Ozden et al. | |

(Continued)

OTHER PUBLICATIONS

Extended European Search Report dated Jun. 27, 2016 for corresponding EP Patent Application No. 15199946.3, 8 pages.

*Primary Examiner* — Matthew Eason
(74) *Attorney, Agent, or Firm* — Vista IP Law Group, LLP

(57) ABSTRACT

A hearing aid includes: a wireless communication element for wireless communication; a signal processing element for providing an audio signal; a connector for coupling an in-ear element to the hearing aid; a first conductor connected to the wireless communication element; and a second conductor configured for carrying the audio signal to the connector; wherein the first conductor is capacitively coupled to the second conductor or the connector during an operation of the hearing aid.

23 Claims, 7 Drawing Sheets

(56) References Cited

U.S. PATENT DOCUMENTS

| | | | | |
|---|---|---|---|---|
| 2014/0321685 | A1* | 10/2014 | Rabel | H01Q 1/273 381/324 |
| 2015/0172834 | A1 | 6/2015 | Solum | |
| 2015/0281859 | A1* | 10/2015 | Fischer | H01Q 1/273 381/315 |
| 2016/0345109 | A1* | 11/2016 | Polinske | H01Q 1/243 |
| 2016/0373867 | A1* | 12/2016 | Ozden | H04R 25/02 |

* cited by examiner

HEARING AID

RELATED APPLICATION DATA

This application claims priority to and the benefit of European Patent Application No. 15199946.3 filed Dec. 14, 2015, pending. The entire disclosure of the above application is expressly incorporated by reference herein.

FIELD

The present disclosure relates to a device for receiving wireless signals, which comprise an audio component, and playing audio derived from the audio component to a user. In particular, although not exclusively, the application relates to a hearing aid.

BACKGROUND

Typically, hearing aids perform the main function of picking up audio signals from the environment around them, processing and amplifying the audio signals and outputting, via a receiver, otherwise referred to as a loudspeaker, acoustic signals based on these signals to a user. However, some hearing aids have the additional functionality of being configured to receive wireless signals comprising an audio component from a transmitter. For example, the wireless signals may be transmitted to such hearing aids via Bluetooth®. The transmitter may be linked to an electronic device, for example a television. In this way, using the example of a television, the audio component of the television content can be wirelessly transmitted directly to a hearing aid worn by a user. The received wireless signal is then processed and audio corresponding to the audio component of the television content is played to the user.

SUMMARY

An antenna is an important component in a hearing aid that is configured to receive wireless signals. The electrical length of the antenna may correspond to a fraction of the wavelength of the radiation to be received. For example, the electrical length of the antenna may be equivalent to a quarter of a wavelength, half of a wavelength or five eighths of a wavelength. As such, a sufficiently long antenna may be provided in order to receive radiation of a given wavelength or wavelengths.

The length of an antenna may be limited by the size and shape of the hearing aid itself, in particular a housing of a hearing aid. For example, a number of restrictions on the size and shape of the housing may be imposed by the shape of the human ear. Additionally, it may be desirable to make hearing aids as small as possible, so as to be discreet and comfortable to wear.

As such, there is a trade-off between, one on hand, the length of the antenna needing to be sufficiently long in order to receive signals of a particular wavelength and, on the other hand, a desire to fit the antenna inside a housing of a hearing aid which is as small as possible.

Accordingly, it may be desirable to have an antenna configuration which is able to receive wireless signals, whilst taking up as little space as possible within a housing of a hearing aid.

In some arrangements, a hearing aid is provided which comprises a wireless communications element for wireless communication and a signal processing element for providing an audio signal. The hearing aid further comprises a connector for coupling an in-ear element to the hearing aid. For example, the connector may comprise a male or female plug portion. At least a portion of the connector may be comprised of a conducting material, for example metal. The hearing aid comprises a first conductor connected to the wireless communications element. The hearing aid further comprises a second conductor configured for carrying the audio signal to the connector. One or more of the first and second conductors and the connector are arranged such that, in use, there is a capacitive coupling between the first conductor and either the second conductor or the connector. In some arrangements, the first conductor and the second conductor or the first conductor and the connector are arranged in sufficient proximity such that there is a capacitive coupling, otherwise referred to as a capacitance, between them. In some arrangements, the first and second conductors act as at least part of an antenna which, in some arrangements, may be described as a loop antenna or may be described as exhibiting characteristics of a loop antenna. One or both of the first and second conductors may comprise a wire or a strip of metal. Such a strip of metal may be provided on a printed circuit board (PCB), for example.

The second conductor may, in some arrangements, electrically connect the signal processing element to the connector (which couples an in-ear element to the hearing aid). The signal processing element may be, in turn, electrically connected to the wireless communications element and may be configured to receive at least an audio component of a wireless signal from the wireless communications element. As mentioned above, the first conductor may be connected to the wireless communications element. The first and second conductors may thus be electrically connected to each other via the wireless communications element and the signal processing element.

In some arrangements, the wireless communications element and the signal processing element may be entirely separate from each other. For example, they may be provided as separate modules. The signal processing element and the wireless communications element may each have an input and an output (or multiple inputs and/or multiple outputs). Equally, however, in some arrangements the signal processing element and the wireless communications element may be integrated with one another and be provided on a single chip or within a single module. In this case, the wireless communications element and the signal processing element may have a common input and a common output (or multiple common inputs and/or multiple common outputs).

As mentioned above, in use, there is a capacitive coupling between the first conductor and either the second conductor or the connector. The wireless signals (which, in some arrangements may be radio frequency or 'RF' signals) are of sufficiently high frequency so as to be able to pass between a gap between either the first and second conductors or between the first conductor and the connector (depending on the configuration), which is bridged by the capacitive coupling. As such, the electrical length of the antenna may span the first conductor, the wireless communications element, the signal processing element, the second conductor and the gap, bridged by the capacitive coupling. This configuration thus may act as the antenna for receiving wireless signals.

Advantageously, this configuration may allow the length of the antenna over which wireless signals are received to be increased to include not only the first conductor but also the second conductor, which connects the signal processing element to the connector. This may be particularly advantageous as the second conductor would be present in the hearing aid anyway, in order to provide an electrical connection between the signal processing element and the connector. In other words, the hardware which is already in the hearing aid may form part of the antenna, thus increasing its length.

The above-described configuration may also be advantageous for the following reason. As mentioned above, the frequency of the wireless signals (typically RF signals) is sufficiently high such that, from the point of view of the wireless signals, the capacitive coupling bridges the gap between the first conductor and the second conductor or the first conductor and the connector. Once the wireless signals have been received, these are processed by the signal processing element. The signals which are output by the signal processing element are of much lower frequencies. As such, they are not able to pass from the second conductor to the first conductor (or from the connector to the first conductor) via the gap between them, as the RF signals are. In this way, the gap acts as a filter, preventing the flow of such signals across this path. If there was a direct electrical connection (i.e. a physical electrical connection) between the end of the first conductor and the connector, a filter or capacitor would be needed to ensure that signals output by the signal processing element are not passed back to the first conductor.

An arrangement may also be described as follows. In some arrangements, a hearing aid for receiving a wireless signal and deriving audio for playing into an ear of a user therefrom is provided. The hearing aid may comprise a wireless communications module (otherwise referred to as a wireless communications element) configured to receive, via an antenna, a wireless signal comprising an audio component. The antenna may be a loop antenna or may exhibit characteristics of a loop antenna. The hearing aid may further comprise a signal processor (otherwise referred to as a signal processing element) configured to receive at least the audio component of the received wireless signal from the wireless communications module, process the audio component to produce an audio signal and output the audio signal. The hearing aid may also comprise a connector for coupling an in-ear element to the hearing aid and a first conductor forming a first part of the antenna. The hearing aid may also comprise a second conductor configured to provide an electrical connection between the signal processor and the connector, for carrying the audio signal output by the signal processor to the connector for playing the audio signal to a user via the in-ear element. The second conductor may form a second part of the antenna and the first and second conductors may be configured to act, in combination, as at least a portion of said antenna. As mentioned above, the antenna may be a loop antenna or may have characteristics of a loop antenna.

As mentioned above, in some arrangements, the first and second conductors may act as at least part of the antenna and a loop comprising of the first and second conductors, the wireless communications element and the signal processing element and completed by the capacitive coupling may be formed. It is this assembly that, in some arrangements, may act as the antenna for receiving wireless signals. This configuration thus may increase the length of the antenna (as compared to e.g. if only the first conductor were to act as the antenna) so as to facilitate the matching of the length of the antenna to a suitable fraction of the wavelength of the radiation to be received.

As well as being described as a loop antenna, the above-described antenna configuration could also be thought of as a monopole antenna. From the perspective of the received wireless (often RF) signals, the audio circuitry (including the signal processing element and its associated circuitry) acts as a ground connection. Therefore, the antenna configuration could also be described as a monopole antenna with an end connected to ground.

In some arrangement, the first and second conductors may each have first and second portions respectively. The respective first portions of the first and second conductors may be electrically connected to one another via the wireless communications element and the signal processing element. The respective second portions of the first and second conductors may be adjacent to one another. The respective second portions of the first and second conductors may be arranged in sufficient proximity such that, in use, a capacitive effect is present between them. In some arrangements, the capacitive effect may complete a loop of a loop antenna.

The first conductor may, in some arrangements, have a free end. In other words, the first conductor may have a free end which is not electrically connected to another component or element of the hearing aid. The free end of the first conductor may be mechanically connected to another component or element of the hearing aid, however. In some arrangements, the free end of the first conductor may be adjacent to the second portion of the second conductor.

In some arrangements, the second portion of the first conductor may be at or adjacent to the connector, such that a capacitive effect is present between the second portion of the first conductor and the connector. In some arrangements, the second portion of the first conductor and the connector may be arranged in sufficient proximity such that a capacitive effect is present between them. As mentioned above, in some arrangements, the first conductor may have a free end. The free end of the first conductor may be adjacent to the connector, such that, in use, there is a capacitive coupling between the free end of the first conductor and the connector.

At least one of the first and second conductors may be configured, in some arrangements, to extend in a first direction for a first distance and a second direction for a second distance. In other words, one or both of the first and second conductors may comprise at least one bend. Advantageously, this configuration may allow the first and second conductors to have a longer length (as opposed to if they did not comprise any bends) and still fit within a given housing of a hearing aid.

In some arrangements, the hearing aid may comprise a housing with a plurality of faces. The housing may enclose the wireless communications element, the signal processing element and at least a portion of the first and second conductors. In some arrangements, the housing may enclose one or both of the first and second conductors entirely.

The housing may, in some arrangements, be configured to be worn behind an ear of a user, for example resting on the back of the pinna of a user. It may be comprised of plastic, for example. One or more of its faces may be flat (or substantially flat) or curved.

One or both of the first and second conductors may be arranged, in some arrangements, along two or more of the faces of the housing of the hearing aid. For example, one or both of the first and second conductors may run along two or more of the faces of the housing. In this way, one or both of the first and second conductors may be arranged to run around the inside of the housing such that the first and/or second conductors can have as great a length as possible (or at least an increased length) and still be enclosed within the housing. In some arrangements, one or both of the first and second conductors may run parallel or substantially parallel to one or more (or two or more) of the faces of the housing. For example, at least a portion of one or both of the first and second conductors may extend at an angle from one or more of the faces of the housing. In some arrangements, this angle may be 25 degrees, or approximately 25 degrees, for example.

In some arrangements, at least a portion of the first conductor may extend along a first face of the housing and at least a portion of the second conductor may extend along an opposing face of the housing. One or both of the first and second conductors may extend along a top face of the housing.

At least a portion of the first conductor may extend in a clockwise direction about a longitudinal axis of the hearing aid in some arrangements of the hearing aid. In some arrangements, at least a portion of a second wire may extend in an anti-clockwise direction about a longitudinal axis of the hearing aid.

In some arrangements, the wireless communications element and the signal processing element; and the connector and second portion of the first conductor, may be positioned at opposing ends of the hearing aid. In other words, the wireless communications element and the signal processing element may be disposed at one end of the hearing aid (or a housing of the hearing aid) and the connector and the second portion of the first conductor may be disposed at another end of the hearing aid (or a housing of the hearing aid). This is another way of maximising (or at least increasing) the length of the antenna (and the first and second conductors in particular) that can fit inside a housing of the hearing aid.

It should be understood that in some arrangements, one or both of the first and second conductors may comprise a portion which extends outside of a housing of the hearing aid.

In some arrangements, the hearing aid may comprise a battery connector. The battery connector may be configured to connect a battery to circuitry within the hearing aid, in particular in order to provide the wireless communications element and the signal processing element with power. The battery connector may be positioned at the same end of the hearing aid as the wireless communications element and the signal processing element. For example, the battery connector (and optionally, in use, the battery itself) may be disposed between the wireless communications element and an end of a housing of the hearing aid). Equally, the battery connector may be disposed elsewhere within a housing of the hearing aid.

A system for receiving a wireless signal and playing audio derived from the wireless signal into an ear of a user is also provided. The system comprises a hearing aid as in any of the arrangements described above and also an in-ear element. The in-ear element is configured to be placed in the ear of a user. The in-ear element may comprise a receiver, (otherwise referred to as a speaker, a loud speaker or an output transducer).

In some arrangements of the system, the system may further comprise a coupling element configured to couple the in-ear element to the hearing aid via the connector. In some arrangements, the coupling element may itself comprise a connector, configured to connect with the above-described connector provided on the hearing aid. For example, the connector on the coupling element may comprise a male or female plug portion, configured to interlock with the connector provided on the hearing aid.

The coupling element may, in some arrangements, comprise a third conductor which electrically connects the receiver to the second conductor, for example via the two connectors. The third conductor may comprise a wire, for example, or otherwise be strip of conducting material, such as metal for example. In any case, it may have an elongated shape and/or be wire-like. The third conductor may be configured to relay a signal from the second conductor to the receiver in the in-ear element. In some arrangements, the coupling element may comprise a housing, for example a plastic tube disposed around the third conductor or other insulation around the third conductor.

In some arrangements, in use, the capacitance between the first conductor and the second conductor (or the first conductor and the connector) may be between 0.5 picoFarads and 50 picoFarads. As mentioned above, the hearing aid may be configured to receive radio frequency (RF) signals. Typically, the wavelength of such signals is between a few MegaHertz and ten or so GigaHertz, in particular between 0.5 GHz and 10 GHz. Particular examples of the frequency of the received RF signals are 1 GHz, 2.4 GHz and 5 GHz.

It will be understood that a hearing aid as described herein may comprise other components and features which may or may not be pertinent to the described functionality of receiving wireless signals. For example, the hearing aid may comprise a microphone, which may otherwise be referred to as an acoustic-to-electric transducer. Such a microphone is configured to convert acoustic signals into electric signals.

The hearing aid may comprise further components, such as a balun, a matching circuit, a capacitor and a digital-to-analogue converter (DAC) disposed in between the following pairs of components:

The wireless communications element and the first conductor

The signal processing element and the second conductor

The third conductor and the second conductor

The third conductor and the receiver.

A hearing aid includes: a wireless communication element for wireless communication; a signal processing element for providing an audio signal; a connector for coupling an in-ear element to the hearing aid; a first conductor connected to the wireless communication element; and a second conductor configured for carrying the audio signal to the connector; wherein the first conductor is capacitively coupled to the second conductor or the connector during an operation of the hearing aid.

Optionally, each of the first and second conductors has a first portion and a second portion, wherein the respective first portions of the first and second conductors are electrically connected to one another via the wireless communication element and the signal processing element, and wherein the respective second portions of the first and second conductors are adjacent to one another with sufficient proximity such that a capacitive effect is present between them.

Optionally, each of the first and second conductors has a first portion and a second portion, wherein the respective first portions of the first and second conductors are electrically connected to one another via the wireless communication element and the signal processing element, and wherein the second portion of the first conductor is at or is adjacent to the connector, such that a capacitive effect is present between them.

Optionally, the first conductor has a free end, and the free end of the first conductor is adjacent to the second portion of the second conductor.

Optionally, the first conductor has a free end, and the free end of the first conductor is at or is adjacent to the connector.

Optionally, at least one of the first and second conductors is configured to extend in a first direction for a first distance, and in a second direction for a second distance.

Optionally, the hearing aid further includes a housing with a plurality of faces, wherein the housing encloses the wireless communication element, the signal processing element, and at least a portion of the first and second conductors, and wherein one or both of the first and second conductors are arranged along two or more of the faces.

Optionally, the wireless communication element and the signal processing element are at a first end of the hearing aid, and the connector and the second portion of the first conductor are at a second end of the hearing aid that is opposite from the first end.

Optionally, the hearing aid further includes a battery connector, wherein the battery connector is at the first end of the hearing aid.

Optionally, the wireless communication element is configured to receive a signal comprising an audio component; and the signal processing element is configured to receive at least the audio component of the received signal, and process the audio component to provide the audio signal.

Optionally, the second conductor is configured to provide an electrical connection between the signal processing element and the connector for carrying the audio signal, and wherein the connector is configured to provide the audio signal for the in-ear element.

Optionally, the hearing aid is configured to receive radio frequency (RF) signals.

A system for receiving a wireless signal and playing audio derived from the wireless signal into an ear of a user, includes: the hearing aid; and the in-ear element.

Optionally, the system further includes a coupling element configured to couple the in-ear element to the hearing aid via the connector.

Optionally, the in-ear element comprises a receiver, and wherein the coupling element comprises a third conductor which electrically connects the receiver to the second conductor via the connector.

Other and further aspects and features will be evident from reading the following detailed description.

DESCRIPTION OF THE FIGURES

Arrangements are now described in detail by way of example, with reference to the accompanying drawings, in which.

DETAILED DESCRIPTION

Figure 1:
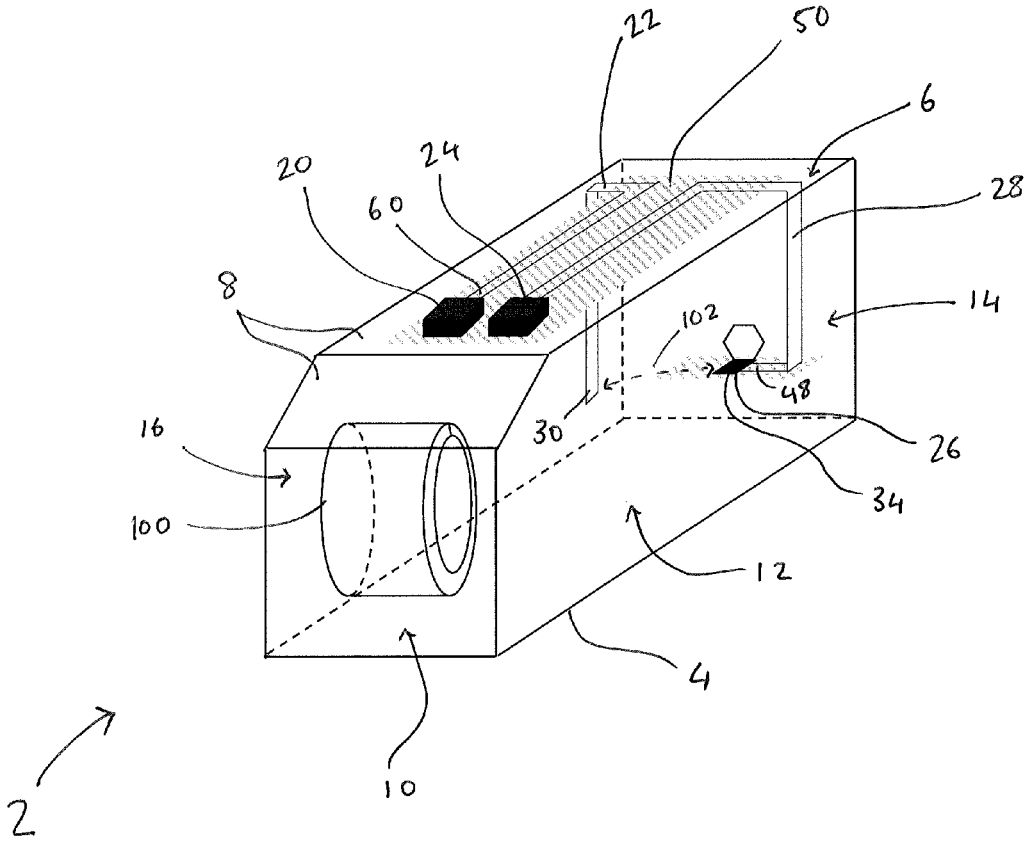
FIG. 1 illustrates schematically a hearing aid configured to receive wireless signals.

Various embodiments are described hereinafter with reference to the figures. It should be noted that the figures are not drawn to scale and that elements of similar structures or functions are represented by like reference numerals throughout the figures. It should also be noted that the figures are only intended to facilitate the description of the embodiments. They are not intended as an exhaustive description of the invention or as a limitation on the scope of the invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated, or if not so explicitly described.

The present description relates to advantageous configurations of components within a hearing aid. In particular, arrangements of a hearing aid comprise an antenna connected to a wireless communications element (e.g. a radio) for receiving a wireless signal. The wireless communications element is connected to a signal processing element (e.g. a digital signal processor) arranged to produce an audio signal from the received signal. A second conductor connects the signal processing element to a connector, which is configured to connect the hearing aid to an in-ear element. The in-ear element comprises a speaker and is configured to be placed in an ear of a user. The audio signal that derives from the wireless signal can therefore be played to the user through the in-ear element. The antenna, the wireless communications element, the signal processing element, the second conductor and the connector act, in combination, with the antenna, as part of the antenna arrangement for receiving wireless, for example RF, signals from a transmitter. Such a transmitter may be linked to an electronic device, such as a television, and may be configured to transmit the audio component of television content, for example, to the hearing aid. An end of the antenna is disposed in sufficient proximity to the connector (or the end of the second conductor which is connected to the connector) such that, in use, a capacitive coupling exists between the end of the antenna and the connector (or the end of the second conductor which is connected to the connector). In this way, the wireless (e.g. RF) signals are received over a loop formed by the antenna, the wireless communications element, the signal processing element, the second conductor and the connector, the loop being completed by the above-mentioned capacitive coupling. Advantageously, a suitable length antenna can be provided with a minimal number of components, which in turn enables a smaller hearing aid to be provided.

With reference to FIG. 1, a hearing aid 2 comprises a housing 4, which in turn comprises a plurality of faces, as follows: a front face 6, a top face 8, a back face 10, a bottom face 12, a first side face 14 and a second side face 16. Each face has an internal surface and an external surface. The hearing aid 2 further comprises, enclosed within the housing 4, a printed circuit board (PCB) 50. The PCB 50 is parallel to a portion of the top face 8.

Provided on the PCB 50 is a wireless communications element 20. The wireless communications element 20 is configured to receive (and optionally transmit) wireless signals via an antenna (which will be described below). In addition, the wireless communications element 20 is arranged to extract one or more relevant portions of the received signal from the received signal, such as the audio component. The wireless communications element 20 is essentially a radio and may be referred to as such. The wireless communications element 20 has an input which is electrically connected to a first end 60 of a first conductor 22. The first conductor 22 has an elongated shape and, as well as the first end 60, has a second, free end 30. The first conductor may comprise, for example, a strip of metal provided on the PCB. Equally, the first conductor may comprise a wire. The first conductor 22 acts as part of the antenna configuration, for receiving wireless signals from a transmitter, as will be described below. Such a transmitter may, in line with the example provided above, be connected to a source such as a television and may be configured to transmit wireless signals comprising the audio component of television content, for example, to the hearing aid.

Also provided on the PCB 50 is a signal processing element 24. The signal processing element may otherwise be referred to as a digital signal processor. An input of the signal processing element is electrically connected to an output of the wireless communications module 20. For example, there may be a conductor (for example a strip of electrically conducting material) on the PCB in between the output of the wireless communications element and the input of the signal processing element to provide an electrical connection between the two. The signal processing element 24 is configured to receive signals from the wireless communications element 20 and process the received signals. Processing the signals may include amplifying the signals, for example. It may also include converting the received audio component into a form suitable for driving an output such as a speaker. The flow of signals throughout the device will be described in full below.

Provided on the housing 4 of the hearing aid is a connector 26, which is configured to provide a connection between the hearing aid 2 and an in-ear element, which will be described below with reference to FIG. 4. The connector 26 comprises a conducting portion 34, which may be, for example, metallic.

A second conductor 28 connects an output of the signal processing element 24, to the connector 26. Like the first conductor 22, the second conductor 28 has an elongated shape. It may comprise a strip of metal on the PCB 50, for example. It may otherwise comprise a wire. The second conductor 28 is configured to relay signals output by the signal processing element to the connector 26. From the connector 26, the signals are then relayed to the in-ear element via a coupling element, as will be described below.

The signal processing element 24 and the wireless communications element 20 are provided at a first end of the housing 4 and the connector 26 and the free end 30 of the first conductor 22 are disposed at another end of the housing 4. Advantageously, by positioning the signal processing element 24 and the wireless communications element 20 at a first end of the housing 4 and the connector 26 and the free end 30 of the first conductor 22 at a second, opposing end of the housing 4, the first and second conductors extend along a length of the housing 4. This may facilitate the first and second conductors having a sufficiently long length such that the electrical length of the antenna is matched to a fraction of the wavelength of the radiation to be received.

The free end 30 of the first conductor 22 and the connector 26, in particular the metallic portion 34 of the connector, are arranged in sufficient proximity such that there is, in use, a capacitive coupling between the free end 30 and the metallic portion 34 of the connector. The distance over which this capacitive coupling acts is indicated by arrow 102.

The hearing aid 2 further comprises a battery 100, connected to the signal processing element and the wireless communications element, for providing power to the wireless communications element 20 and the signal processing element 24.

The path taken by various signals through the components of the hearing aid 2 will now be described with reference to FIGS. 2 and 3. As a first step, a wireless signal comprising an audio component is transmitted from a transmitter, for example a transmitter connected to a television. The wireless signal is received by an antenna configuration of the hearing aid 2.

Figure 2:
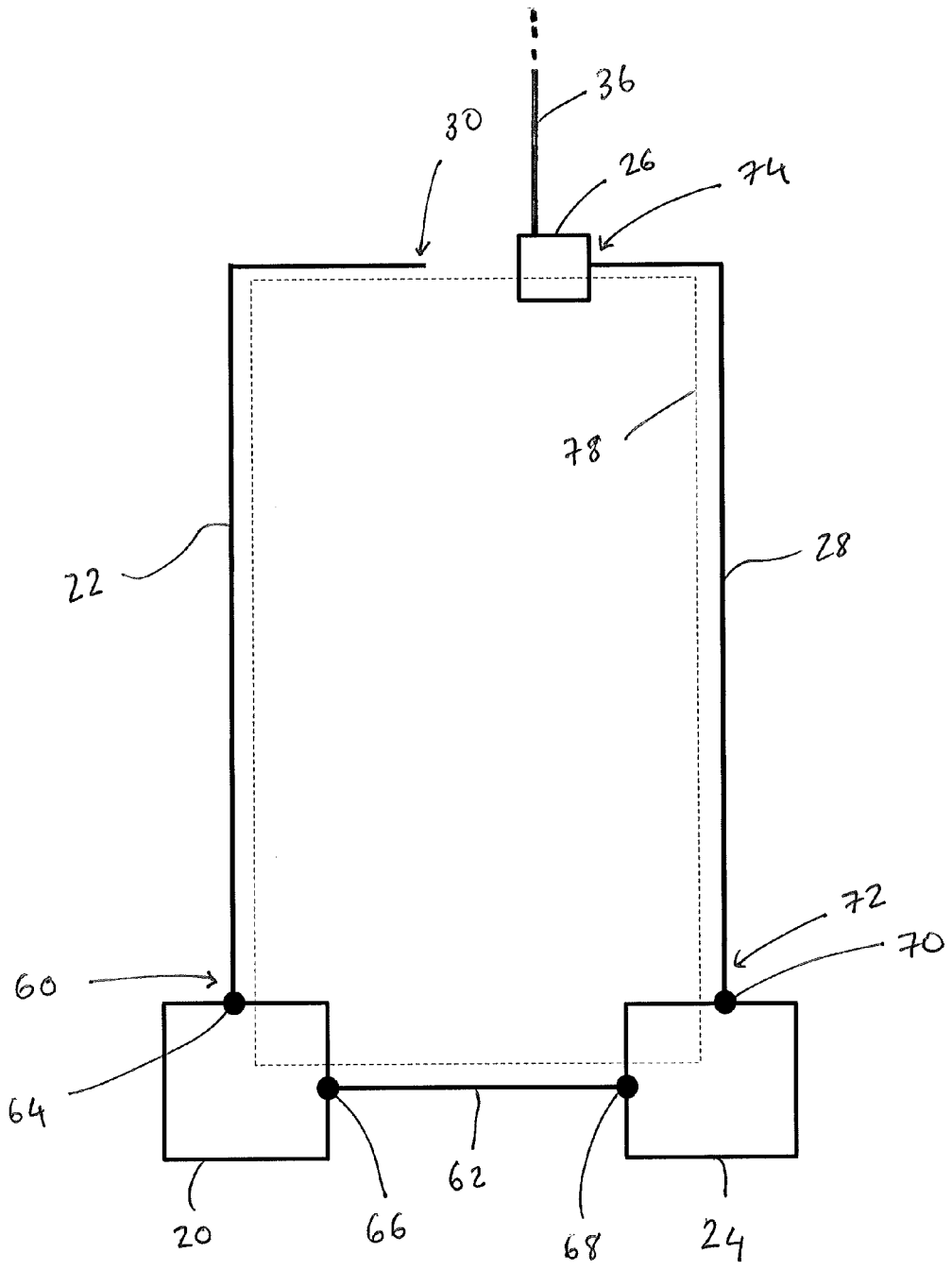
FIG. 2 illustrates schematically components of a hearing aid as illustrated in FIG. 1.

With reference to FIG. 2, the antenna configuration is described. The following components act, in combination, as the antenna:

The first conductor 22
The wireless communications element 20
A conductor 62
The signal processing element 24,
The second conductor 28 and
The connector 26

As set out above, an end 60 of the first conductor 22 is connected to an input 64 of the wireless communications element 20. An output 66 of the wireless communications element 20 is connected to first end of a conductor 62. A second end of conductor 62 is connected to an input 68 of the signal processing element 24. An output 70 of the signal processing element is connected to a first end 72 of the second conductor 28. A second end 74 of the second conductor 28 is connected to the connector 26. As described above, the connector is configured to provide a connection between the hearing aid 2 and an in-ear element.

In use, a wireless signal transmitted by a transmitter (for example linked to a television) induces an RF, electronic signal in the antenna configuration. The frequency of the induced signal is sufficiently high such that there is a capacitive coupling between the free end 30 of the first conductor 22 and the connector 26, in particular a conductive portion of connector 26. As such, the wireless RF signal induces an electrical signal over a loop formed by the above-listed components and completed by a capacitive coupling between the free end 30 and the connector 26. This loop is indicated with dashed line 78 in FIG. 2. In this way, the antenna configuration may be described as a loop antenna, or at least may be described as having characteristics of a loop antenna.

Figure 3:
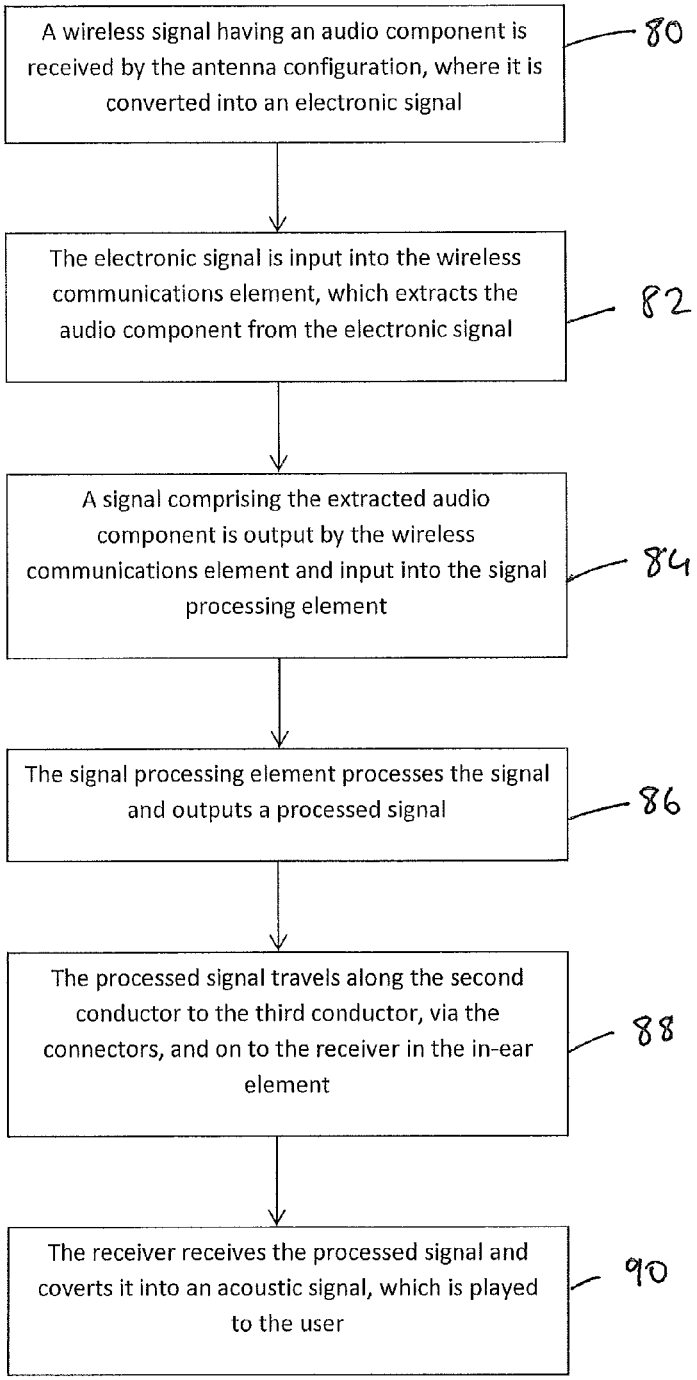
FIG. 3 illustrates a flow diagram representing the flow of signals between the components shown in FIGS. 1 and 2.

With reference to FIG. 3, in step 80, a wireless signal having an audio component is received by the antenna configuration of the hearing device. In particular, an electronic signal is induced in the antenna configuration.

In step 82, this electronic signal is received by wireless communications element 20, via input 64 (see FIG. 2). The wireless communications element 20 then extracts the audio component from the received signal.

In step 84, the wireless communications element 20 outputs a signal comprising the audio component to an input 68 of the signal processing element 24.

The signal processing element 24, then, in step 86, processes the signal received from the wireless communications element 20. In particular, the signal processing element 86 amplifies the received signal and outputs the amplified signal via output 70 to the second conductor 28.

In steps 88 and 90, the signal output by the signal processing element travels along the second conductor 22 to the connector 26. From there, the signal travels on, to the in-ear element (specifically, a receiver in the in-ear element) via a third conductor 36.

As mentioned above, the signal output by the signal processing element 20 is of much lower frequency that the RF signals received by the antenna. The high-frequency nature of the RF signals means that the gap between the free end 30 and the connector 26 is bridged by the capacitive coupling. However, the lower-frequency signals output by the signal processing element 20 are not able to pass over the gap, from the connector 26 to the free end 30 of the first conductor 22. In this way, the gap acts as a filter, preventing the signals output by the signal processing element 20 from passing from the connector 26 to the first conductor 22. Instead, the signal continues along to the in-ear element via the third conductor 36.

Figure 4:
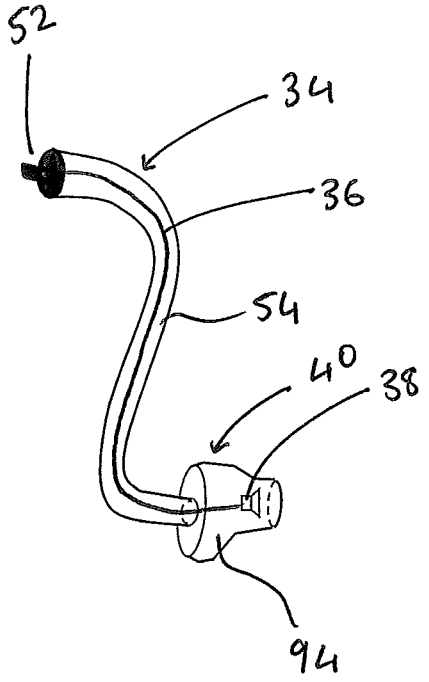
FIG. 4 illustrates an in-ear element and a coupling element, configured to be connected to a hearing aid, for example a hearing aid as illustrated in FIG. 1.

With reference to FIG. 4, a coupling element 54 and an in-ear element 40 configured for use with a hearing aid as described above are described.

The in-ear element 40 is configured to be placed in the ear of a user. The in-ear element 40 comprises a housing 94, which encloses a receiver 38, which may be otherwise referred to as a loud speaker or an output transducer. The receiver 38 is configured to convert a received electronic signal (received from the signal processing element 24) to an acoustic signal. The in-ear element 40 is connected to a coupling element 54. The coupling element 54 comprises the third conductor 36 and a housing 34 (otherwise referred to an insulation 34) around the third conductor 36. A first end of the third conductor 36 is connected to the receiver 38 and a second end of the third conductor 36 is connected to a second connector 52, which is configured to interlock with the connector 26 of the hearing aid (see FIG. 1). In this way, the third conductor 36 is configured to provide an electrical connection between the second conductor and the receiver 38, via the two connectors 26 and 52.

In use, a signal output by the signal processing element 24 travels along the second conductor 28 (see FIG. 1) to the connector 26. The signal then travels along the third conductor 36 (see FIG. 2) via the connector 26 and the connector 52 to the receiver 38. The receiver 38 converts the signal into audio, to be played to the user.

It will be appreciated that the wireless communications element 20, the signal processing element 24 and also the first and second conductors and the connector 26 can be arranged in a number of different ways within the housing 4 of the hearing aid 2. For example, the positions of these various elements may be dictated by the positions of other hardware within the housing (for example a microphone or other circuitry) as well as by the desired length of the first and second conductors.

Figure 5:
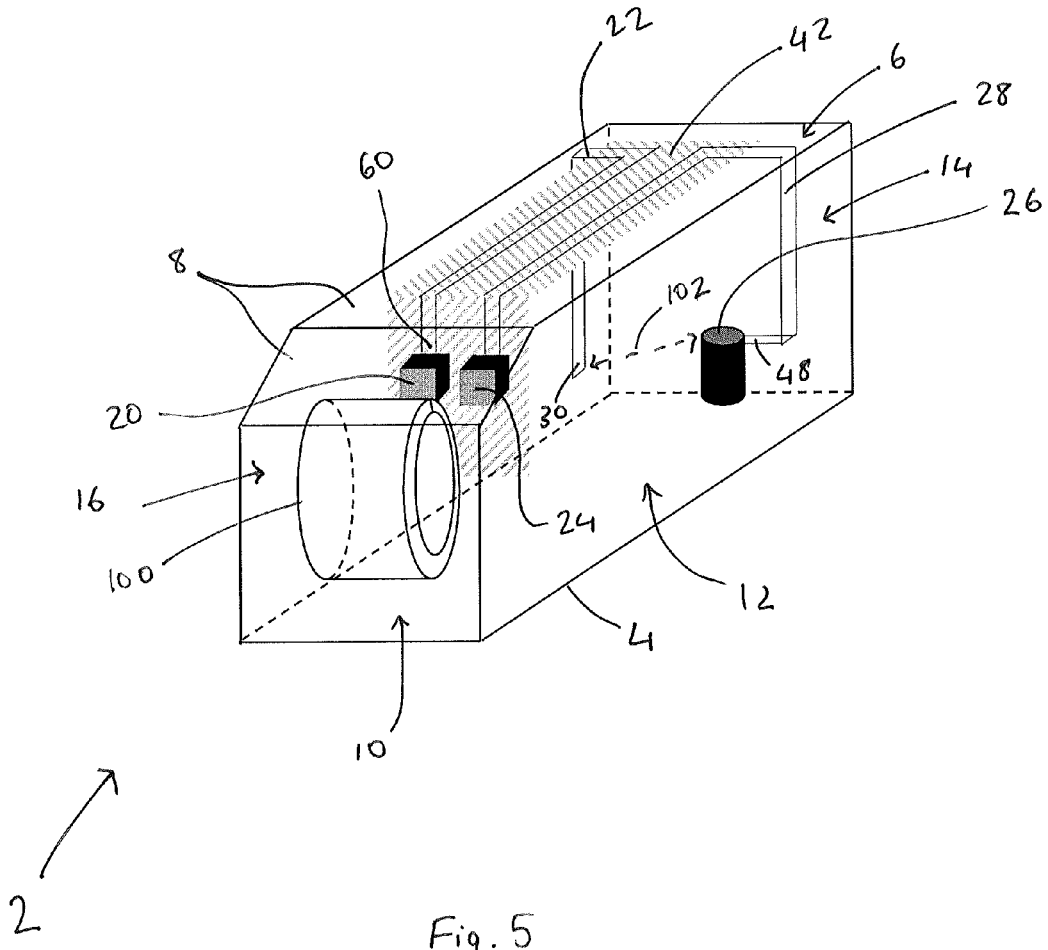
FIGS. 5, 6 and 7 illustrate alternative configurations of the components of the hearing aid described with reference to FIG. 1.

With reference to FIG. 5, an alternative configuration of the components of the hearing aid 2 is described. In this arrangement, the wireless communications element 20 and the signal processing element 24 are arranged on a PCB 42 which is arranged vertically, i.e. parallel to the front face 10 of the housing 4. Portions of the first and second conductors 22 and 28 extend along a portion of the top side 8 of the housing 4. A further portion of the first conductor 22 extends along the second side face 16 of the housing 4. A further portion of the second conductor 28 extends along a first side face 14 of the housing 4. In this configuration, the first and second conductors, 22 and 28, may have a greater length than in the configuration as illustrated in FIG. 1.

Figure 6:
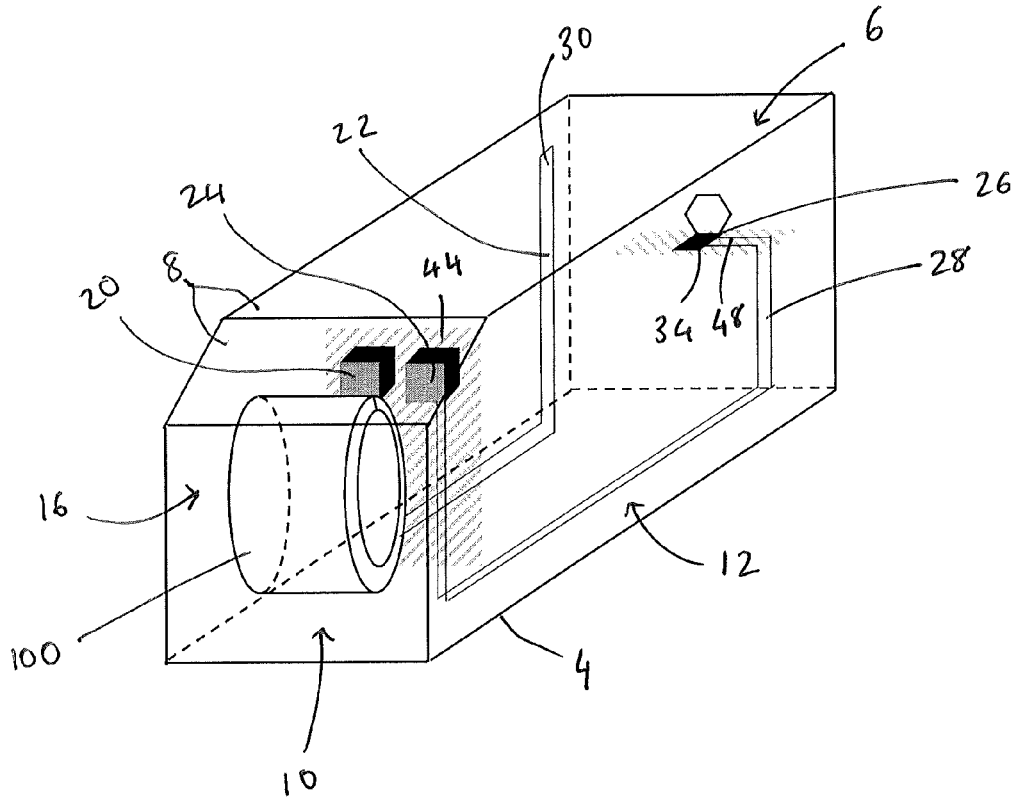

With reference to FIG. 6, a further configuration of the components enclosed within the housing 4 is described. The wireless communications element 20 and the signal processing element 24 are disposed on a PCB 44 which is arranged vertically, i.e. parallel to the front face 10 of the housing 4. In this instance, portions of the first and second conductors 22 and 28 run along the bottom face 12 of the housing 4. A further portion of the first conductor 22 runs along the second side face 16 of the housing 4 and a further portion of the second conductor 28 runs along the back face 6 of the housing. This is another way of increasing the length of the first and second conductors.

Figure 7:
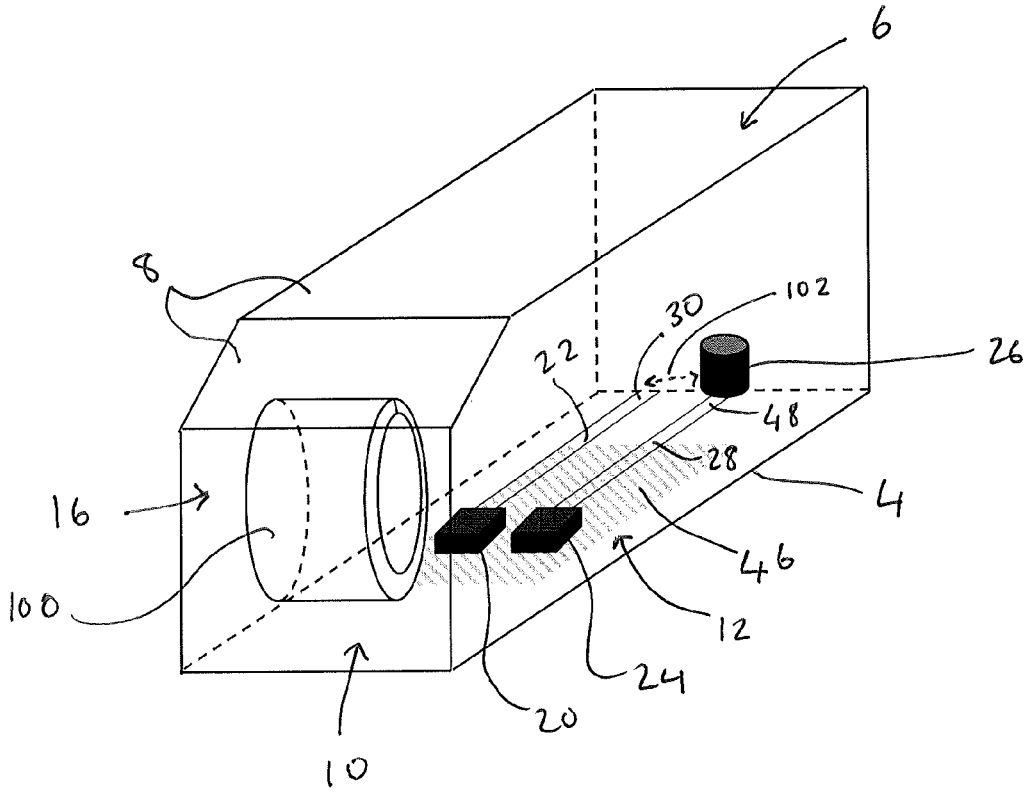

As mentioned above, the effective length of the antenna must be matched to a fraction of the wavelength of the radiation to be received. As such, it may not necessarily be advantageous to maximise the length of one or both of the first and second conductors. In particular, the first and second conductors may not run along multiple faces of the housing 4, but instead may run parallel to a single face of the housing, for example. With reference to FIG. 7, an alternative configuration of the first and second conductors, the signal processing element 24 and the wireless communications element 20 is described. In this arrangement, the signal processing element 24 and the wireless communications element 20 are arranged on a PCB 46 which is parallel to a bottom face 12 of the housing 4. The first conductor 22 runs parallel to the second conductor 28 and both the first and second conductors extend parallel to the bottom face 12 of the housing. In use, a capacitive coupling is provided between the end 30 of the first conductor 22 and the connector 26, as indicted by arrow 102.

As mentioned above, a capacitive coupling may exist either between the first conductor and the second conductor or between the first conductor and the connector. Specifically, with reference to FIGS. 1, 3, 4 and 5, the capacitive coupling may exist between the free end 30 of the first conductor 22 and an end 48 of the second conductor 28 (see FIGS. 1, 5, 6 and 7), rather than between the free end 30 of the first conductor and the conductive portion 34 of the connector 26.

The term 'hearing aid' has been used in the above description to refer to the portion of the device comprising the housing 4, i.e. the components within the housing and the housing. Equally, however, 'hearing aid' may also be taken to include the coupling element and the in-ear element, for example.

The above description of the arrangements is made by way of example only and various modifications, alternations and juxtapositions of the described features will occur to the person skilled in the art. It will therefore be apparent that the above description is made for the purpose of illustration of arrangements and not limitation of scope of protection, which is defined in the appended claims.

The invention claimed is:

1. A hearing aid comprising:

a wireless communication element for wireless communication;

a signal processing element for providing an audio signal;

a connector for coupling an in-ear element to the hearing aid;

a first conductor connected to the wireless communication element; and a second conductor configured for carrying the audio signal to the connector;

wherein the first conductor is galvanically isolated from the connector, wherein the first conductor is configured to form a capacitive coupling with the second conductor or the connector during an operation of the hearing aid, the capacitive coupling bridging a gap of a loop to provide a characteristic of a loop antenna.

2. The hearing aid according to claim 1, wherein each of the first and second conductors has a first portion and a second portion, wherein the respective first portions of the first and second conductors are electrically connected to one another via the wireless communication element and the signal processing element, and wherein the respective second portions of the first and second conductors are adjacent to one another with sufficient proximity such that a capacitive effect is present between them.

3. The hearing aid according to claim 1, wherein each of the first and second conductors has a first portion and a second portion, wherein the respective first portions of the first and second conductors are electrically connected to one another via the wireless communication element and the signal processing element, and wherein the second portion of the first conductor is at or is adjacent to the connector, such that a capacitive effect is present between them.

4. The hearing aid according to claim 2, wherein the first conductor has a free end, and the free end of the first conductor is adjacent to the second portion of the second conductor.

5. The hearing aid according to claim 3, wherein the first conductor has a free end, and the free end of the first conductor is at or is adjacent to the connector.

6. The hearing aid according to claim 1, wherein at least one of the first and second conductors is configured to extend in a first direction for a first distance, and in a second direction for a second distance.

7. The hearing aid according to claim 1, further comprising a housing with a plurality of faces, wherein the housing encloses the wireless communication element, the signal processing element, and at least a portion of the first and second conductors, and wherein one or both of the first and second conductors are arranged along two or more of the faces.

8. The hearing aid according to claim 2, wherein the wireless communication element and the signal processing element are at a first end of the hearing aid, and the connector and the second portion of the first conductor are at a second end of the hearing aid that is opposite from the first end.

9. The hearing aid according to claim 8, further comprising a battery connector, wherein the battery connector is at the first end of the hearing aid.

10. The hearing aid according to claim 1, wherein:

the wireless communication element is configured to receive a signal comprising an audio component; and the signal processing element is configured to receive at least the audio component of the received signal, and process the audio component to provide the audio signal.

11. The hearing aid according to claim 1, wherein the second conductor is configured to provide an electrical connection between the signal processing element and the connector for carrying the audio signal, and wherein the connector is configured to provide the audio signal for the in-ear element.

12. The hearing aid according to claim 1, wherein the hearing aid is configured to receive radio frequency (RF) signals.

13. A system for receiving a wireless signal and playing audio derived from the wireless signal into an ear of a user, the system comprising:

the hearing aid according to claim 1; and the in-ear element.

14. The system according to claim 13, further comprising a coupling element configured to couple the in-ear element to the hearing aid via the connector.

15. The system according to claim 14, wherein the in-ear element comprises a receiver, and wherein the coupling element comprises a third conductor which electrically connects the receiver to the second conductor via the connector.

16. The hearing aid according to claim 1, wherein the first conductor is galvanically isolated from the second conductor to prevent a direct conduction path between the first conductor and the second conductor.

17. The hearing aid according to claim 1, wherein the loop comprises an open conductor loop, wherein the first conductor is a first part of the open conductor loop, and wherein the second conductor is a second part of the open conductor loop.

18. The hearing aid according to claim 1, wherein the loop comprises an open conductor loop, wherein the first conductor is a first part of the open conductor loop, and wherein the connector is a second part of the open conductor loop.

19. The hearing aid according to claim 1, wherein the first conductor is capacitively coupled to both the second conductor and the connector during the operation of the hearing aid.

20. The hearing aid according to claim 1, wherein the first conductor is galvanically isolated from the connector to prevent a direct conduction path between the first conductor and the connector.

21. A hearing aid comprising:

a wireless communication element for wireless communication;

a signal processing element for providing an audio signal;

a connector for coupling an in-ear element to the hearing aid;

a first conductor connected to the wireless communication element; and a second conductor configured for carrying the audio signal to the connector;

wherein the first conductor is a first part of an open conductor loop; and wherein the first conductor is is configured to form a capacitive coupling with the second conductor or the connector during an operation of the hearing aid, the capacitive coupling bridging a gap of the open conductor loop to provide a characteristic of a loop antenna.

22. The hearing aid according to claim 21, wherein the second conductor is a second part of the open conductor loop.

23. The hearing aid according to claim 21, wherein the connector is a second part of the open conductor loop.

* * * * *